United States Patent [19]

McGoldrick

[11] 4,209,212

[45] Jun. 24, 1980

[54] JEWELRY DISPLAY HOUSING

[76] Inventor: Darlene M. McGoldrick, P.O. Box 513, Randolph AFB, Tex. 78148

[21] Appl. No.: 933,718

[22] Filed: Aug. 15, 1978

[51] Int. Cl.[2] ..... A47F 5/08

[52] U.S. Cl. ..... 312/245; 312/223; 206/564; 40/902

[58] Field of Search ..... 312/227, 245, 223, 326, 312/140.3, 224, 237; 206/564, 45.19; 220/22.3; 40/324, 902

[56] References Cited

U.S. PATENT DOCUMENTS

| | | | |
|---|---|---|---|
| 1,844,050 | 2/1932 | Wesley et al. | 312/223 |
| 1,956,205 | 4/1934 | Scruggs | 206/562 |
| 1,978,819 | 10/1934 | Roller | 312/223 |
| 2,041,303 | 5/1936 | Shields | 206/564 |
| 2,717,819 | 9/1955 | Kirkwood, Jr. | 312/245 |
| 2,718,326 | 9/1955 | LeBlanc | 312/140.3 |
| 2,720,045 | 10/1955 | Miller | 40/902 |
| 2,788,123 | 4/1957 | Levis et al. | 206/45.19 |
| 3,442,039 | 5/1969 | Saizelet | 312/223 |
| 3,486,610 | 12/1969 | Hain et al. | 312/245 |
| 3,930,702 | 1/1976 | Pichowicz | 312/245 |

*Primary Examiner*—Victor N. Sakran

*Attorney, Agent, or Firm*—Robert D. Farkas

[57] ABSTRACT

A jewelry display housing utilizes an elongated rigid sheet having a soft wadding-like material disposed adjacent a lateral surface thereof, a fabric-like covering is disposed over the wadding material and is provided having a plurality of nail-like fasteners extending outwardly therefrom, each disposed at an acute angle relative to the rigid sheet. A fabric-like member is provided having one edge thereof disposed secured to an edge of the sheet and extending over the fabric-like layer covering the wadding, in flap-like fashion. Doors are provided covering the ends of the fasteners. A reflector is disposed within the housing comprising the doors and the sidewalls attached to the sheet, to which a switch is mounted engaging the doors when they are closed. The switch is mounted in electrical series circuit with a battery mounted on the housing. Pierced earrings are disposed having their shank portion passing through the flap-like fabric sheet with the fasteners serving as support for other forms of jewelry. The flap-like sheet fabric material may also be utilized to support ornamental pins and brooches and the like. The lamp becomes energized when both doors are opened upon the release of the switch operating lever.

9 Claims, 5 Drawing Figures

JEWELRY DISPLAY HOUSING

BACKGROUND OF THE INVENTION

The Field of the Invention

This invention relates to display devices and more particularly to that class adapted for the display of jewelry of various types and sizes, all to be carried by a universally functional display housing.

DESCRIPTION OF THE PRIOR ART

The prior art abounds with jewelry display devices. U.S. Pat. No. 2,718,326 issued Sept. 20, 1955 to H. J. LeBlanc teaches a housing having a door-like cover through which a variable number of uniform size cells may be disposed behind the cover fabricated from a plurality of rigid members, each having transverse notches and grooves therewithin, permitting the user to erect such members in a variable number of uniform size cells. The LeBlanc apparatus suffers its deficiency of requiring that articles to be stored within the cells must be of the same maximum size and the apparatus must be employed having the cells' open-mouth portions disposed above the cells, thereby preventing the contents of the cells from accidentally spilling outwardly therefrom.

U.S. Pat. Nos. 2,788,123, issued Apr. 9, 1957 to R. R. Levis et al., and 2,105,550, issued Jan. 18, 1938 to T. J. Pilliod et al., and 1,956,205 issued Apr. 24, 1934 to C. H. Scrugs, all teach a fabric-like material either fabricated from fabric or a resilient foam-like sheet, having disposed therewithin openings or grooves for receiving extensions of jewelry therethrough. Such grooves or openings are arranged in uniform patterns so as to permit such jewelry to be positioned within one or more grooves or openings. However, each of the aforementioned devices fail to provide a useful apparatus for storage of earrings, of the type having a removeable component, frequently found used with pierced ears. Such devices require the removeable component to be stored with the balance of the earring, lest such removeable component be lost. Furthermore, each of the aforementioned teachings fails to provide an apparatus in which the removeable component is engaged on a lateral surface of the fabric-like member opposed to the other lateral surface thereof carrying the body of the earring. Brooches or other jewelry items supported by fabrics when worn, may not be effectively stored on these devices.

SUMMARY OF THE INVENTION

A primary object of the present invention is to provide a jewelry display housing having storage facilities for earrings, the type worn on pierced ears.

Another object of the present invention is to provide a housing which may be utilized to support jewelry of all types.

Still another object of the present invention is to provide a housing in which the jewelry carried therein may be viewed at all times.

Yet another object of the present invention is to provide a housing which permits some of the jewelry to be stored therein to be hung from rod-like elements and other jewelry-like ornaments to be pinned to a flexible fabric member and providing a loose flap-like member for securing articles of jewelry therethrough.

A further object of the present invention is to provide an illuminated area for the housing.

Another object of the present invention is to provide a housing having doors effectively covering the storage area, thereby maintaining the jewelry in a safe and clean environment.

Still another object of the present invention is to provide lamp illumination when the doors of the housing are opened, facilitating use of the apparatus in a darkened room.

Yet another object of the present invention is to provide a housing which is economical to manufacture, sturdy in construction, compact in size, convenient to use and totally effective for storing therewithin a large quantity of a wide variety of jewelry items of diverse sizes, shapes and fastening constructions.

Heretofore, housings for storing jewelry consisted of primarily two varieties. The first variety utilized individual compartments in which the jewelry was stored such that the open-mouth portion provided access to each compartment and such that the open-mouth portion was coverable by a removeable, or slidable, or integral cover affixed to the housing carrying the compartments therewithin. Such devices failed to provide an apparatus suitable for use as a display, thereby requiring the user to maintain the open-mouth portions of the compartments in a horizontal, or near horizontal plane. The other form of jewelry display included a multitude of horizontally disposed grooves, openings, or rods arranged in spaced apart relationship, one above the other, and residing in planes disposed in a near vertical direction. The jewelry was either hung from the rods or caused to have portions thereof inserted in the openings or grooves. Such openings or grooves were almost invariably provided having resilient marginal edges so as to maintain the grasped portion of the jewelry removeably locked within the openings and grooves. In this fashion, frictional forces maintain the individual jewelry items in hopefully locked engagement with the openings and grooves. Unfortunately, certain forms of jewelry, notably pierced earrings, have detachable components, which when detached are frequently lost. Such components, when attached to the remainder of the earring, provide an obstacle for securing the earring when it is to be stored away. The removeable component usually extends rigidly outwardly from a rod-like portion of the earring and when engaged in the grooves or slots of the latter category of prior art devices, created a bulky portion of the jewelry, frequently too large to be comfortably inserted within the lips of the openings and grooves.

The present invention recognizes these difficulties and provides an economical yet totally functional solution therefor. By utilizing a hanging flap-like fabric sheet member, the stud-like earrings are caused to have the stud portion pass through the fabric-like material such that the display portion of the pierced earrings is disposed on one lateral surface of the flap material, and the removeable component end of the stud portion of the earring is disposed adjacent the other lateral surface of the flap. The removeable component is then installed, locking the jewelry to the fabric-like flap. Other portions of the apparatus include a fabric-like layer of material disposed underneath the flap, supported on a layer of wadding-like material covering a rigid sheet. A plurality of nails, disposed angularly upwardly from the sheet surface, and outwardly from the fabric-like covering thereof, provides a hanging structure for hanging thereon a wide variety of jewelry items, including rings, earrings, bracelets, necklaces, brooches, pins, and the like. Brooches and pins, employing pin-like fasteners, may be secured either to the flap portion, in much the same fashion as they are to be secured to an article of apparel, or they may be hung by the nail-like fasteners otherwise disposed surrounding the location of the flap. In one embodiment, the sheet is surrounded by upstanding walls to which are affixed a pair of rigid doors. A lamp is included within the housing defined by the doors, walls, and sheet, such that the lamp, when illuminated, provides illumination for the jewelry items stored on the flap and on the nail-like fastening devices. Thus, the user may utilize the present invention in a darkened room, such as a bedroom. By providing a foldable back-like leg, secured to the unused lateral surface of the rigid sheet, the present invention may be stood, in an inclined plane, relative to a supporting surface, thereby providing a pleasing and functional storage apparatus. Alternatively, a pair of eyehooks may be utilized secured to the rearmost lateral surface of the rigid sheet such that the entire apparatus may be hung from a wall-like surface.

These objects as well as other objects of the present invention, will become more readily apparent after reading the following description of the accompanying drawings.

DESCRIPTION OF THE PREFERRED EMBODIMENT

Figure 1:
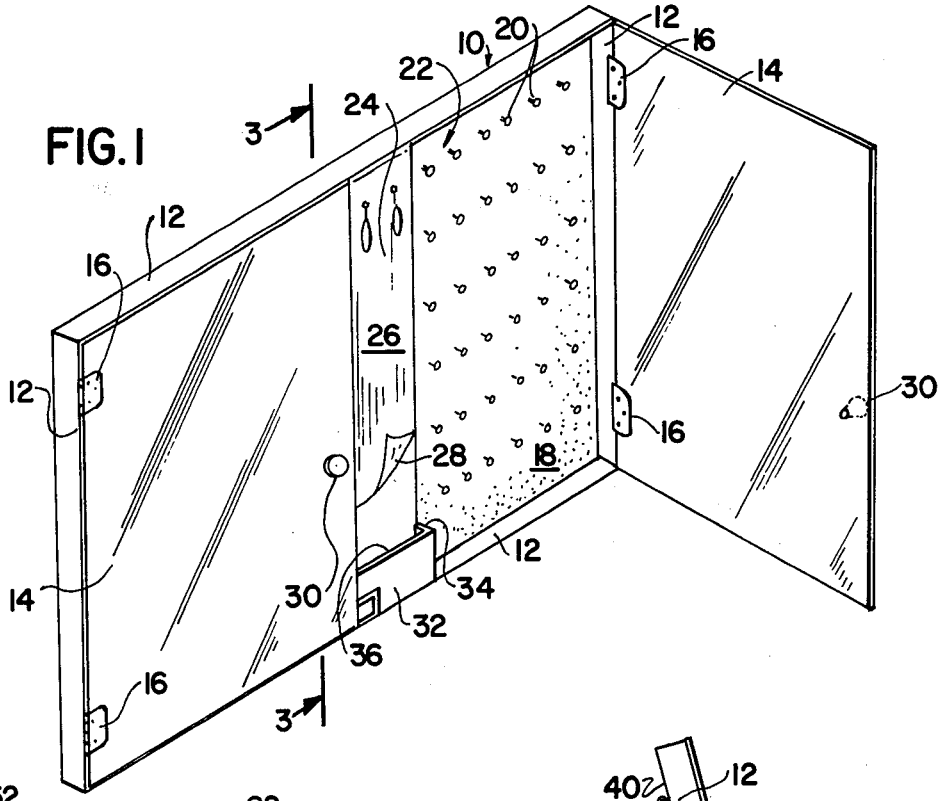
FIG. 1 is a prospective view of the present invention.

The structure and method of fabrication of the present invention is applicable to a rigid rectangular sheet, preferably fabricated from an inexpensive material, such as plywood. One lateral surface of the rigid sheet is covered with a wadding-like material, such as natural or synthetic wadding with a layer of adhesive interposed therein between. The outermost lateral surface of the wadding is covered with a fabric-like material, such as a dark colored velvet, so as to totally cover the lateral surface of the rigid sheet having the wadding thereon. A portion of the fabric-like covering for the rigid sheet is disposed covered by a flap-like fabric member having one edge thereof secured to the opposed uncovered lateral surface of the rigid sheet, and having the other marginal edges thereof residing adjacent to the lateral surface of the sheet used to cover a portion of the fabric covering of the wadding. The area surrounding the location of the flap, when the flap is juxtaposed with the fabric covering of the wadding, is provided having a plurality of nail-like fasteners extending outwardly therefrom, so as to each extend at a uniform angle relative to the plane defining the lateral surfaces of the sheet, whereby the pointed end of the fasteners are disposed passing through the wadding and engaging the rigid sheet. By inclining each of the fasteners, the display apparatus comprising the present invention may be moved from place to place without fear that the jewelry devices depending downwardly from such fasteners will accidentally become dislodged.

A border of walls are secured adjacent the marginal edges of the sheet and are disposed extending outwardly from the surface of the sheet carrying the wadding. A pair of doors are secured with hinges to oppose marginal edges of the walls such that the doors, when closed, completely conceal their behind fabric-like covering of the wadding. Such doors, if desired, may be fabricated from a transparent material, such as an acrylic plastic.

A portion of the fabric-like material, disposed covering the wadding, is provided having an opening. Such opening communicates with an opening in the wadding and an opening in the rigid sheet, all being juxtaposed and at equal dimensions. A sub-housing is provided, such sub-housing having an open-mouth portion disposed passing through the opening in the layers of covering, wadding, and rigid sheet. The sub-housing includes a battery there within and a reflector having an incandescent lamp passing therethrough. The terminals of the battery, and the terminals of the lamp, are each disposed in the series electrical circuit with a momentary push button switch terminals. The operating lever of the push button switch is disposed outwardly from the sub-housing and outwardly from a planar reflecting sheet material. Such reflecting sheet is disposed secured juxtaposed with the opening, but spaced apart therefrom so as to extend outwardly from the fabric covering of the wadding. Thus, when the doors are disposed in a closed condition, each door element engages a portion of the operating lever of the switch, maintaining such switch in an open circuited condition, thereby precluding energizing the incandescent lamp. When both doors are open, the operating lever is biased outwardly, in the manner well known in the art, thereby causing the momentary switch to be disposed in a closed circuited condition, causing current flow to energize the lamp. Light rays, emanating outwardly from the incandescent lamp, are disposed leaving the innermost surface of the reflecting sheet and outwardly from the boundaries thereof illuminating all jewelry items disposed within the housing, whilst eliminating the possibility that the incandescent lamp may be viewed directly by a user.

A back-flap sheet is hingeably secured along one marginal edge thereof to the outermost lateral surface of the rigid sheet. Such back-flap member is cut having one marginal edge thereof disposed angularly relative to the pivot axis thereof, wherein said pivot axis resides parallel with the lateral surfaces of the rigid sheet. In this fashion, the housing may be disposed on the supporting surface when the back-flap member is pivoted outwardly from the rigid sheet portion. Alternatively, a pair of eyehooks, disposed fastened to the outermost lateral surface of the rigid sheet, provide vertical support for the housing when they are utilized to engage hooks or other protrusion-like devices fastened to a vertical supporting surface, such as a wall. In this application, the back-flap member is folded back so as to reside parallel to the lateral surfaces of the sheet.

Now referring to the figures, and more particularly to the embodiment illustrated in FIG. 1 showing the present invention 10 having walls 12 to which doors 14 are pivotably secured utilizing hinges 16 therefor. Surface 18 is shown having a plurality of nail-like fasteners 20 extending outwardly therefrom. Surface 18 may be seen extending parallel to doors 14, when such doors are disposed in a closed condition closing open mouth portion 22 of the present invention. Fabric-like flap 24 is shown having an outermost lateral surface 26 and an innermost lateral surface 28. Handle 30 is shown carried on doors 14. Reflecting sheet 32 is shown supported on post 34 located adjacent opening 36.

Figure 2:
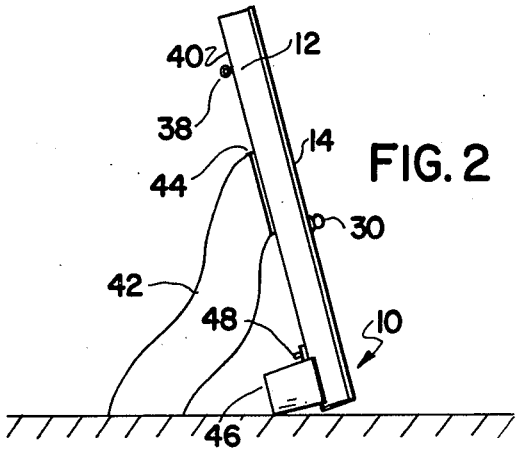
FIG. 2 is a side elevation view of the apparatus shown in FIG. 1.

FIG. 2 illustrates eye-like fastener 38 disposed on rearmost surface 40 of the present invention 10. Back-flap portion 42 is shown pivotably secured to surface 40, utilizing hinge 44 therefor. Sub-housing 46 is shown carried on surface 40, utilizing bolts 48 therefor.

Figure 3:
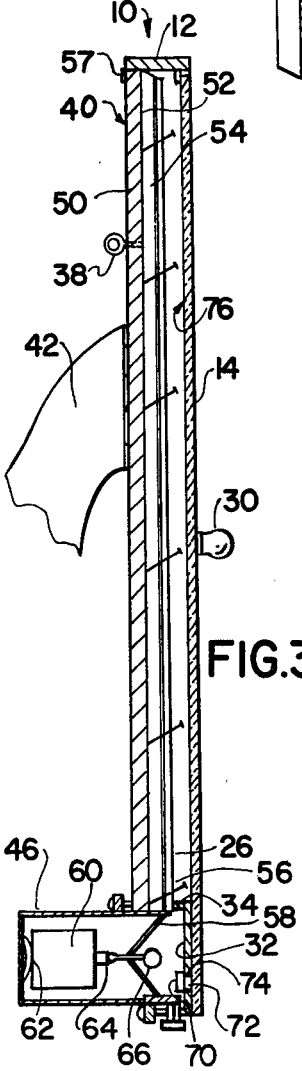
FIG. 3 is a side elevation cross sectional view, taken along lines 3—3, viewed in the direction of arrows 3—3, of the apparatus shown in FIG. 1.

FIG. 3 illustrates the present invention 10 having rigid sheet 50, of which surface 40 is shown opposite to opposed lateral surface 52 thereof. Wadding 54 is shown adjacent surface 52 and is covered by fabric-like layer 56. Flap 26 is shown having end 57 thereof secured to surface 40, utilizing an adhesive therefor. Reflector sheet 32 is shown mounted on posts 34, carried on fabric layer 56 adjacent opening 58. Battery 60 is shown within sub-housing 46 utilizing spring element 62 so as to urge terminal 64 in contact with lamp 66. Lamp reflector 68 is shown disposed in and behind reflector 32, carrying switch 70. Operating lever 72, of switch 70, is disposed passing through hole 74, in reflector 32. With doors 14 in the position shown, innermost surface 76 engages operating plunger 72 so as to open circuit incandescent lamp 66 and thereby maintain such lamp in a deenergized condition.

Figure 4:
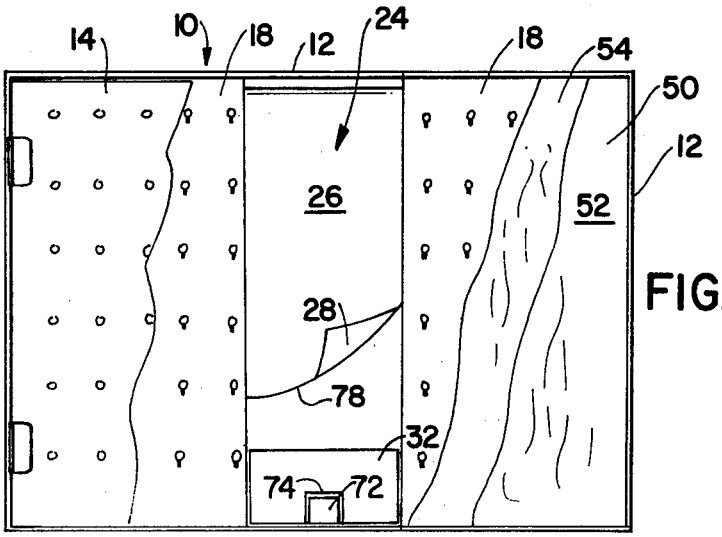
FIG. 4 is a front elevation view of the present invention, as shown in FIG. 1, having the door portions thereof removed.

FIG. 4 illustrates present invention 10 shown having door 14, in cutaway fashion, partially covering fabric-like layer 18. Flap 24 is shown having lowermost marginal edge 78 thereof shown adjacent the uppermost marginal edge of reflecting sheet 32. Lowermost marginal edge 78, of flap 24, may be disposed upwardly and outwardly from the position shown, so as to permit flap 24 to be utilized having access to lateral surfaces 26 and 28 thereof.

Figure 5:
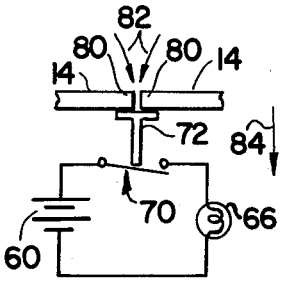
FIG. 5 is the electrical schematic of the electrical components of the present invention.

FIG. 5 illustrates battery 60 and incandescent lamp 66 in a series electrical circuit with switch 70. Operating lever 72 is shown adjacent portions of doors 14. When doors 14 have edges 80 thereof disposed in the direction of arrows 82, operating lever 72 is displaced in the direction of arrow 84, opening switch 70 and terminating current flow in incandescent lamp 66. In this position, doors 14 are closed so as to have the housing shown in FIG. 10 closed.

One of the advantages of the present invention is to provide a jewelry display housing having storage facilities for earrings, the type worn on pierced ears.

Another advantage of the present invention is to provide a housing which may be utilized to support jewelry of all types.

Still another advantage of the present invention is to provide a housing in which the jewelry carried therein may be viewed at all times.

Yet another advantage of the present invention is to provide a housing which permits some of the jewelry to be stored therein to be hung from rod-like elements and other jewelry-like ornaments to be pinned to a flexible fabric member and providing a loose flap-like member for securing articles of jewelry therethrough.

A further advantage of the present invention is to provide an illuminated area for the housing.

Another advantage of the present invention is to provide a housing having doors effectively covering the storage area, thereby maintaining the jewelry in a safe and clean environment.

Still another advantage of the present invention is to provide lamp illumination when the doors of the housing are opened, facilitating use of the apparatus in a darkened room.

Yet another advantage of the present invention is to provide a housing which is economical to manufacture, sturdy in construction, compact in size, convenient to use, and totally effective for storing therewithin a large quantity of a wide variety of jewelry items of diverse sizes, shapes, and fastening constructions.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A jewelry display housing comprising a rigid sheet, a plurality of walls fixedly secured to the marginal edges of said sheet and extending outwardly from one lateral surface thereof, a pair of doors, said pair of doors, hingeably secured to said plurality of walls, a wadding-like pad, said wadding-like pad fixedly secured to said one lateral surface, a first fabric-like sheet, said first fabric-like sheet disposed covering said wadding-like pad and said one lateral surface, a second fabric-like sheet, said second fabric-like sheet having one marginal edge thereof disposed fixedly secured to the other lateral surface of said rigid sheet, a first portion of said second fabric-like sheet being disposed intermediate a portion of said marginal edges of said rigid sheet and a portion of one of said plurality of walls, the remaining portions of said second fabric-like sheet being disposed in flap-like fashion residing covering a portion of said first fabric-like sheet, the other end of the second fabric-like sheet being free from attachment to said first fabric-like sheet and said rigid sheet and said walls, the remaining portions of said first fabric-like sheet having a plurality of nail-like fasteners piercing therethrough and through said wadding-like pad and passing into said rigid sheet, each fastener of said plurality of nail-like fasteners being disposed extending outwardly from said remaining portions of said first fabric-like sheet forming an acute angle therewith.

2. The apparatus as claimed in claim 1 further comprising a housing, a battery, an incandescent lamp, said housing having an open mouth portion, a portion of said remaining portion of said first fabric-like sheet having a first opening therein, said open mouth portion being disposed adjacent said opening, a reflecting sheet, said reflecting sheet being disposed fixedly secured to said remaining portion of said first fabric-like sheet and outstanding therefrom, a switch, said switch having an operating plunger, said switch carried by said reflecting sheet, said operating plunger passing through a second opening in said reflecting sheet, said battery and said switch and said incandescent lamp being disposed in a series electrical circuit, said incandescent lamp being carried within said housing, whereby said incandescent lamp is energized by said battery when both said doors are disposed out of touching engagement with said operating lever.

3. The apparatus as claimed in claim 1 further comprising at least one eye-like fastener, said eye-like fastener being disposed fixedly secured to said other lateral surface of said rigid sheet.

4. The apparatus as claimed in claim 3 wherein one end of said second fabric-like sheet is disposed adjacent to said first opening.

5. The apparatus as claimed in claim 1 wherein said second fabric-like sheet is smaller than said first fabric-like sheet.

6. The apparatus as claimed in claim 1 wherein said rigid sheet comprises wood.

7. The apparatus as claimed in claim 1 further comprising a pair of knobs, said pair of knobs being carried by said pair of doors.

8. The apparatus as claimed in claim 3 wherein said housing is disposed extending outwardly from said other lateral surface of said rigid sheet.

9. The apparatus as claimed in claim 1 wherein said second fabric-like sheet is disposed adjacent the adjacent marginal edges of said pair of doors when said pair of doors are disposed juxtaposed to said first fabric-like sheet.

* * * * *